US009685710B1

(12) United States Patent
Hijmans et al.

(10) Patent No.: US 9,685,710 B1
(45) Date of Patent: Jun. 20, 2017

(54) REFLECTIVE AND PERMEABLE METALIZED LAMINATE

(71) Applicant: Space Systems/Loral, LLC, Palo Alto, CA (US)

(72) Inventors: Carey Hijmans, Morgan Hill, CA (US); Trevor Martens, San Francisco, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 345 days.

(21) Appl. No.: 14/161,343

(22) Filed: Jan. 22, 2014

(51) Int. Cl.
*H01Q 15/14* (2006.01)

(52) U.S. Cl.
CPC ..... *H01Q 15/14* (2013.01); *H01Q 15/141* (2013.01)

(58) Field of Classification Search
CPC ..... H01Q 15/14
USPC ..... 343/912, 915, 897, 840
See application file for complete search history.

(56) References Cited

U.S. PATENT DOCUMENTS 5,093,054 A 3/1992 Hirota
5,178,709 A * 1/1993 Shimodaira ..... B29C 37/0032 156/242
5,223,064 A * 6/1993 Gadkaree ..... B32B 5/26 156/89.25
5,272,679 A * 12/1993 Carpenter ..... B29C 47/0004 114/253
5,686,930 A * 11/1997 Brydon ..... H01Q 15/168 343/897
5,750,058 A * 5/1998 Hecht ..... C04B 35/83 264/29.6
5,959,595 A * 9/1999 Witschen ..... H01Q 15/14 29/600
5,993,934 A * 11/1999 Reese ..... B32B 5/26 264/115
6,064,352 A * 5/2000 Silverman ..... H01Q 15/142 343/897
6,154,185 A * 11/2000 Watanabe ..... H01Q 15/14 343/897
6,833,821 B2 * 12/2004 Amano ..... H01Q 13/0283 343/772

(Continued)

FOREIGN PATENT DOCUMENTS

EP 0182116 5/1986
EP 0595418 5/1994

(Continued)

OTHER PUBLICATIONS

Conductive Composites: "Nickel Coated Nonwovens," [ retrieved on Dec. 6, 2016 from Internet at http://www.conductivecomposites.com/pdf/Nonwoven_datasheet.pdf ], 2 pages.

(Continued)

*Primary Examiner* — Huedung Mancuso
(74) *Attorney, Agent, or Firm* — Weaver Austin Villeneuve & Sampson LLP

(57) ABSTRACT

An antenna reflector includes a laminated structure including a first layer and a second layer, where the first layer has an electrically conductive and electrically reflective front surface and includes a nonwoven metallized fiber matte and the second layer includes an open weave fabric. The laminated structure is acoustically permeable. In some implementations, a laminated structure is formed by co-curing the first layer and the second layer.

20 Claims, 5 Drawing Sheets

(56) References Cited

U.S. PATENT DOCUMENTS

| | | | | |
|---|---|---|---|---|
| 7,324,066 | B2 * | 1/2008 | Hirtt | H01Q 15/144 343/912 |
| 7,993,727 | B2 * | 8/2011 | Sekine | B29C 70/202 156/290 |
| 2004/0009728 | A1 | 1/2004 | Kubomura et al. | |
| 2004/0113863 | A1 | 6/2004 | Stonier | |
| 2006/0270301 | A1 | 11/2006 | Marks | |
| 2008/0277057 | A1 | 11/2008 | Montgomery et al. | |
| 2009/0181168 | A1 * | 7/2009 | Chaubey | C23C 16/4481 427/248.1 |
| 2010/0288433 | A1 | 11/2010 | Montesano et al. | |
| 2011/0221084 | A1 * | 9/2011 | Goodman | C04B 35/571 264/29.5 |
| 2012/0229358 | A1 | 9/2012 | Doneker et al. | |
| 2013/0309396 | A1 | 11/2013 | Legare | |

FOREIGN PATENT DOCUMENTS

| | | |
|---|---|---|
| EP | 0665606 | 8/1995 |
| WO | WO 02/018127 | 7/2002 |

OTHER PUBLICATIONS

TFP: "Optiveil for surface finish," [ retrieved on Dec. 6, 2016 from Internet at http://www.tfpglobal.com/products/optiveil/optiveil-for-surface-finish], 2 pages.

HV: "EMI Shielding," [ retrieved on Dec. 6, 2016 from Internet at http://www.hollingsworth-vose.com/en/Products/Industrial-Products/Advanced-Fiber-Nonwovens/EMI-Shielding], 2 pages.

* cited by examiner

| Matte Material | Basis Weight (grams/m^2) | Surface Resistivity (ohm/square) | Thickness (mm) |
|---|---|---|---|
| Nickel coated Carbon Fiber | 18 | 0.1 | 0.06 |
| Nickel coated Carbon Fiber | 35 | 0.04 | 0.06 |
| Nickel coated Carbon Fiber | 60 | 0.02 | 0.08 |
| Copper and Nickel coated Carbon Fiber | 10 | 0.3 | 0.10 |
| Copper and Nickel coated Carbon Fiber | 20 | 0.2 | 0.20 |
| Copper and Nickel coated Carbon Fiber | 34 | 0.2 | 0.30 |

*Figure 4*

REFLECTIVE AND PERMEABLE METALIZED LAMINATE

TECHNICAL FIELD

This invention relates generally to a laminated material, and more particularly to an antenna reflector configured as a laminated structure where a first layer includes an acoustically permeable, nonwoven metallized fiber matte and a second layer includes an acoustically permeable, open weave fabric.

BACKGROUND OF THE INVENTION

The assignee of the present invention manufactures and deploys spacecraft for, inter alia, communications and broadcast services from geostationary orbit. During launch, such spacecraft experience environmental dynamic loads, particularly acoustic launch loads.

Spacecraft components, including particularly radio frequency (RF) antenna reflectors, are required to be compatible with such launch loads, but must also comply, subsequent to launch, with challenging performance specifications in the face of substantial temperature variations and solar radiation exposure, typical of a space environment. Furthermore, such structures must be designed in view of stringent mass and cost objectives.

Laminated composite structures for such applications have been described, for example, in U.S. Pat. No. 5,686,930, and U.S. Pat Pub. 2004/0113863, assigned to the assignee of the present invention, the disclosures of which are hereby incorporated by reference in their entirety into the present disclosure.

Improved design and fabrication techniques for RF antenna reflectors that achieve excellent RF performance, compatibility with acoustic launch environmental loads, and relatively low mass and cost are desired.

SUMMARY

The present inventors have appreciated that excellent RF performance, compatibility with acoustic launch environmental loads, and relatively low mass and cost may be achieved where the antenna reflector includes a laminated structure including at least two layers. A first layer includes an electrically conductive and electrically reflective front surface, and may include or be composed of an acoustically permeable, nonwoven metallized fiber matte. The second layer may include an acoustically permeable, open weave fabric.

In an implementation, an antenna reflector includes a laminated structure including a first layer and a second layer. The first layer includes an electrically conductive and electrically reflective front surface, the first layer being a nonwoven metallized fiber matte. The second layer includes an open weave fabric.

In a further implementation the laminated structure may be acoustically permeable.

In some implementations, the first layer and the second layer may be co-cured. In other implementations, the first layer and the second layer may be bonded after curing the open weave fabric.

In an implementation, each of the first layer and a second layer may have a thickness not greater than 0.05 inches.

In another implementation, the antenna reflector may include a honeycomb core. The honeycomb core may be sandwiched between the laminated structure and a rear skin, the laminated structure being disposed proximate to a first surface of the honeycomb core and the rear skin being disposed proximate to a second surface of the honeycomb core, the second surface being opposite to the first surface.

In a yet further implementation, the fiber matte may include one or more of carbon fibers, carbon composite fibers, polyamide fibers and glass fibers.

In another implementation, the second layer may include a triaxially woven open weave fiber. The triaxially woven open weave fiber may include one or more of carbon fibers, carbon composite fibers, polyamide fibers and glass fibers.

In an implementation, a method of fabricating a laminated structure for an antenna reflector member includes (i) forming a first layer of an electrically conductive and electrically reflective material, the first layer including a first plurality of gores, each gore including a nonwoven metallized fiber matte; (ii) forming a second layer, the second layer including a second plurality of gores, each gore including an open weave fabric; and (iii) laminating the first layer together with the second layer to form the laminated structure.

In an implementation, forming the first layer may include laying the first plurality of gores on a reflector mold. Forming the second layer may include laying the second plurality of gores on the first layer.

In some implementations, laminating may include co-curing. In other implementations, laminating may include bonding.

In an implementation, the method may further include adhering the laminated structure to a honeycomb core. The honeycomb core may be sandwiched between the laminated structure and a rear skin, wherein the laminated structure is disposed proximate to a first surface of the honeycomb core, and the rear skin is disposed proximate to a second surface of the honeycomb core opposite to the first surface.

BRIEF DESCRIPTION OF THE DRAWINGS

Features of the invention are more fully disclosed in the following detailed description of the preferred embodiments, reference being had to the accompanying drawings, in which:

FIG. 4 illustrates typical properties of metallized mattes suitable for use in the presently disclosed implementations.

Figure 1:
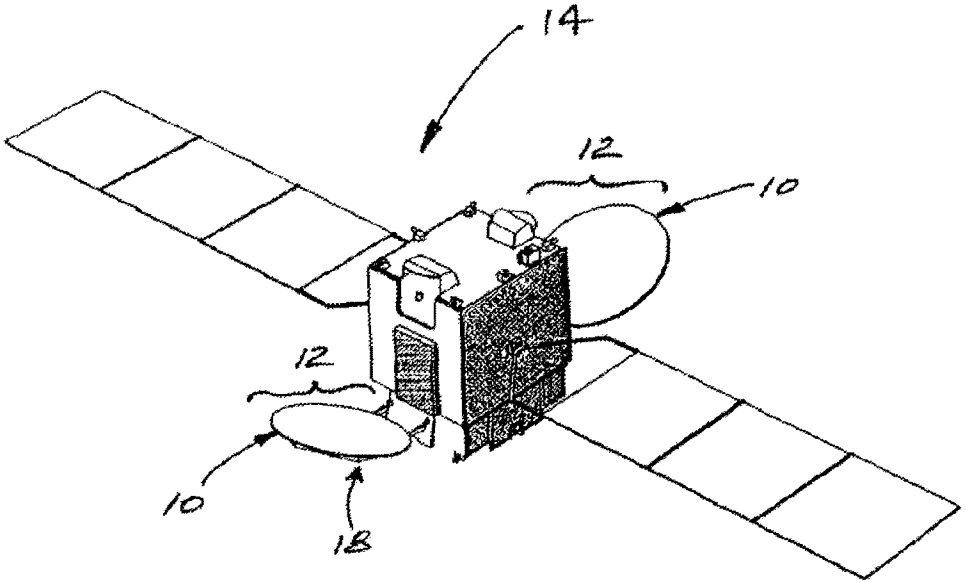
FIG. 1 illustrates an example of a spacecraft in an on-orbit configuration.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the subject invention as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. It will be understood that although the terms "first" and "second" are used herein to describe various elements, these elements should not be limited by these terms. These terms are used only to distinguish one element from another element. As used herein, the term "and/or" includes any and all combinations of one or more of the associated listed items. The symbol "I" is also used as a shorthand notation for "and/or".

The present inventors have appreciated that excellent RF performance, compatibility with acoustic launch environmental loads, and relatively low mass and cost may be achieved where the antenna reflector includes a laminated structure including a first layer and a second layer. The first layer may include an electrically conductive and electrically reflective front surface, and may include or be composed of an acoustically permeable, nonwoven metallized fiber matte. The second layer may include an acoustically permeable, open weave fabric. In some implementations, the first layer may include or be composed of a nonwoven metallized carbon fiber matte, and the second layer may include an acoustically permeable, triaxially woven, open weave carbon fiber fabric.

The metallized carbon fiber matte and woven open weave carbon fiber fabric may include or be composed of fibers of various types. For example, fibers may be composed of carbon, polyamide, or glass, or a combination thereof. When reference is made to "carbon fibers", it will be appreciated that the term is intended to include fibers of substantially pure carbon in the form of graphite or other form and/or carbon composite fibers such as carbon phenolic fibers, for example. Polyamide fibers may consist of aromatic polyamides or aramids such as Kevlar, for example. Glass fibers may consist of E-glass, S-glass, or D-glass, for example. Fibers of other materials may include polyester, molybdenum, beryllium, or quartz, for example.

As used herein, and in the claims, an open weave fabric may consist of fiber tows woven in a pattern that maintains open spacing between consecutive tows to retain the acoustic permeability of the laminate. Woven patterns may be triaxial or biaxial, for example, and may be woven with carbon, polyamide, or other fiber materials previously noted.

In some implementations, the antenna reflector may be part of a spacecraft that includes multiple antenna reflectors and other equipment. Referring to FIG. 1, an example of a spacecraft 14 in an on-orbit configuration is illustrated. In the illustrated example, spacecraft 14 includes two antenna assemblies 12, each antenna assembly 12 including a reflector member 10 and a support structure 18.

Figure 2:
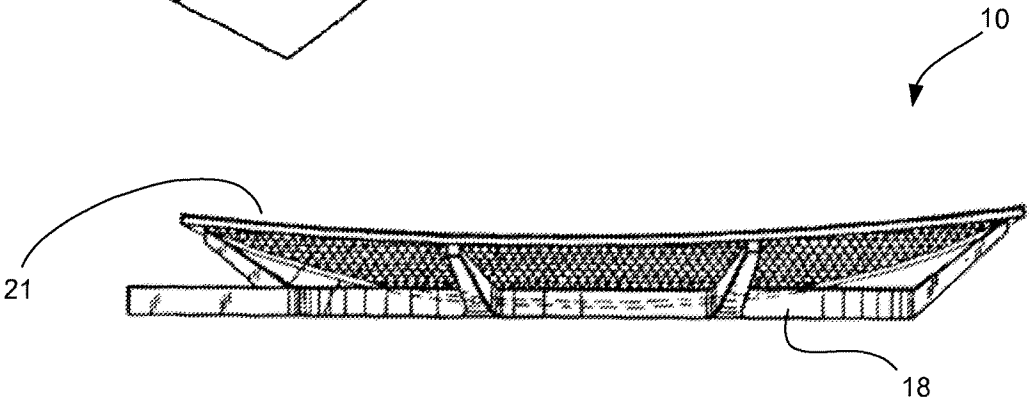
FIG. 2 illustrates an example of a reflector assembly, according to an implementation.

FIG. 2 illustrates an example of reflector assembly 10, according to an implementation. The antenna 12, with reflector member 10, is generally adapted to transmit and receive information and signals over microwaves within one or more frequency bands, for example the Ka-Band or higher microwave frequencies. Reflector member 10 may be any suitable geometric shape including, for example, planar, parabolic or hyperbolic. Reflector member 10 may include an electrically conductive, electrically reflective front surface 21. As described in more detail herein below, in connection with FIG. 3, front surface 21 may be an externally facing surface of a first layer 31. A second layer 24 may be disposed behind the first layer 31. More particularly the second layer 24 may be laminated to a rear surface of the first layer 31.

In some implementations, second layer 24 may be bonded with the first layer 31 such that a front surface of the second layer 24 is laminated to a rear surface of the first layer 31. For example, second layer 24 may be bonded to first layer 31 using an adhesive such as epoxy adhesive. Advantageously, the laminated reflector member 10 may be formed by co-curing second layer 24 with first layer 31 with an appropriate heat/pressure cycle. In some implementations, second layer 24 may include an open weave fabric that is preimpregnated with an appropriate resin system. The heat/pressure cycle may be configured to structurally consolidate the second layer 24 and first layer 31 and to cure the resin system of the preimpregnated open weave material. In some implementations, the resin system may include cyanate ester or epoxy resins that typically undergo a cure temperature between 250 and 350 degrees Fahrenheit for a duration of 2 to 6 hours.

Figure 3:
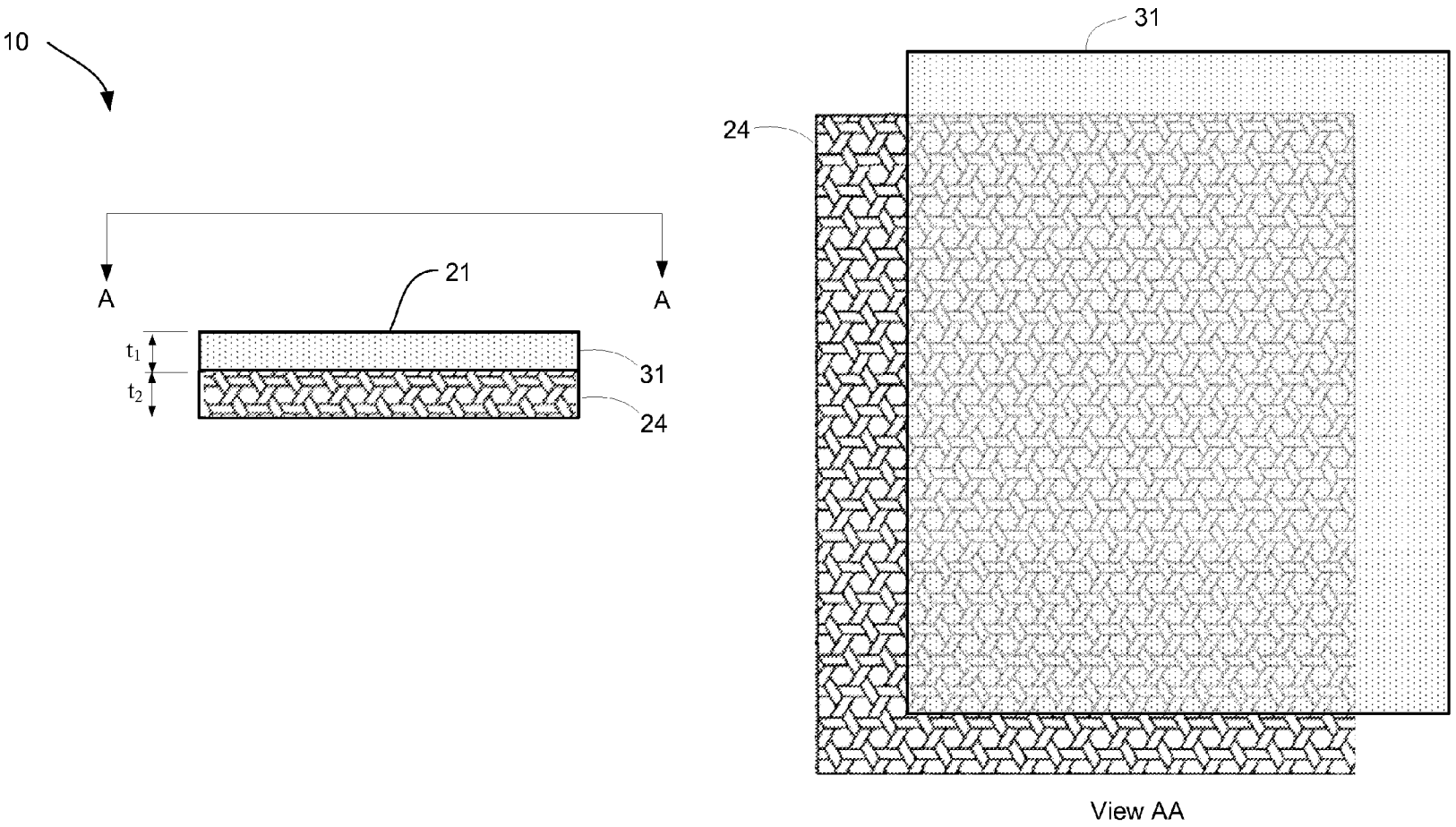
FIG. 3 illustrates an example of a laminated structure, according to an implementation.

Referring now to FIG. 3, reflector member 10 may be configured as a laminated structure including the first layer 31 and the second layer 24. The first layer 31 may include the electrically conductive and electrically reflective front surface 21. Advantageously, first layer 31 may include or be composed of a nonwoven matte or veil of metallized, short-chopped fibers disposed within a binder and having a large percentage of open volume. In some implementations of the nonwoven matte or veil contemplated by the present disclosure, an open volume fraction of 90 to 95% may be obtained. One example of a suitable metallized nonwoven matte is supplied by Conductive Composites of Heber City, Utah, which metallizes nonwoven mattes provided by Hollingsworth & Vose of East Walpole, Mass. Further examples of a suitable nonwoven matte are the Optimat™ and Optiveil™ products available from Technical Fiber Products of Schenectady, N.Y.

The nonwoven matte fibers may be metallized by way of a plating or a chemical vapor deposition (CVD) process, for example of a suitable metal such as, for example, gold, silver, copper, or nickel. In some implementations, the metallization processes performed after the fibers have been formed into a nonwoven matte. In other implementations, the metallization process may be performed on the fibers, which are subsequently cut and formed into the nonwoven matte. Typical properties of metallized mattes suitable for use in the presently disclosed implementations are illustrated in FIG. 4.

The second layer 24 may include an acoustically permeable, open weave fabric of the sort described, for example in U.S. Pat. Pub. 2004/0113863. One example of a suitable open weave fabric is a triaxial woven fabric material supplied by SAKASE ADTECH Co., LTD of Shimoyasuda, Maruoka, Fukui, Japan. For example, a triaxially woven fabric material used designated SK-906 which contains a graphite fiber manufactured by Nippon Graphite Fiber of Tokyo, Japan, designated YS-50A-15S has been found suitable for use in the presently disclosed implementations. In alternate embodiments, other triaxial or biaxial woven fabric materials may be used. In some implementations, a triaxially woven fabric, may have an open area of approximately 30% or greater.

Advantageously, a triaxially woven fabric may be composed of fibers woven along three axes. The resulting fabric may provide quasi-isotropic properties i.e. properties of strength, stiffness, coefficient of thermal expansion, and thermal stability, for example, will be approximately identical in all directions within the fabric. Alternatively, multiple layers of biaxial fabrics, each layer including fibers woven along two axes, may be included in the laminate at different orientations to provide quasi-isotropic properties in the overall laminate.

The open weave fabric material may be combined with a polymer resin material that encapsulates and impregnates the fabric material to form an open weave fabric prepreg. It will be appreciated that the open weave fabric prepreg may be cured under heat and pressure to form a rigid structure, either as a single layer or as a multi-ply layer. In some implementations, curing of the open weave fabric prepreg may take place only after one or more plies of the prepreg have been laid up with the nonwoven matte. In such implementations, the open weave fabric prepreg and the nonwoven matte may be said to be "co-cured".

It will be appreciated that, when co-curing the open weave fabric prepreg with the nonwoven matte, a problem will arise if the polymer resin material from the prepreg migrates significantly into the open volume of the nonwoven matte and reduces the acoustic permeability of the nonwoven. The present inventors have found that, surprisingly, acoustic permeability of the nonwoven matte is at worst only slightly affected by the co-curing process.

Referring again to FIG. 3, it will be appreciated that, in a typical implementation a cross-sectional thickness '$t_i$' of each of the first layer 31 and the second layer 24 may be much smaller than illustrated. For example, in some implementations each of $t_1$ and $t_2$ may be less than 0.01 inches. In some implementations, each of $t_1$ and $t_2$ is less than approximately 0.005 inches, for example. Advantageously, $t_1$ and $t_2$ may each be in the range of 0.003-0.005 inches, for example. In accordance with the presently disclosed techniques, each of the first layer 31 and the second layer 24 is highly permeable to air molecules. For example, the second layer 24 may include a large number of openings between the fibers making up its structure. Similarly, it will be appreciated that the first layer 31, at least at thicknesses, as contemplated, of less than 0.01 inches, is highly permeable to acoustic energy.

The present inventors have appreciated that a laminated arrangement, wherein first layer 31 includes a nonwoven matte of metallized fibers and the second layer 24 includes an open weave fabric as described hereinabove, may be advantageously used to form an RF antenna reflector, particularly for use in spacecraft applications where operation at frequencies at or above Ka-band is desired. Excellent electrical performance is achieved by a rigid structure having a very low coefficient of thermal expansion. In particular, because, in the metallized nonwoven matte, the orientation of the metallized fibers is random and any individual metallized fibers relatively short, the nonwoven matte has an overall coefficient of thermal expansion that is advantageously low. For similar reasons, first layer 31 enhances electrical performance of the reflector member 10, by minimally impacting any polarization of RF energy impinging on the reflector member 10.

The disclosed arrangement is highly permeable to, and therefore relatively unaffected by, acoustic energy in the launch environment. As compared to a closed weave fabric, the second layer 24 of open weave fabric experiences an order of magnitude less acoustic load during a typical satellite launch, thereby enabling significant reduction in the mass of, for example, support structure 18. The open weave fabric may therefore be described as "highly permeable". The addition of a nonwoven metallized fiber matte layer has been found to have no material effect on the acoustic loading of the reflector member 10. Because the first layer 31 includes a myriad of randomly dispersed openings and a very high open volume fraction, a need to align openings in the first layer 31 with openings and the second layer 24 may be avoided.

Figure 5:
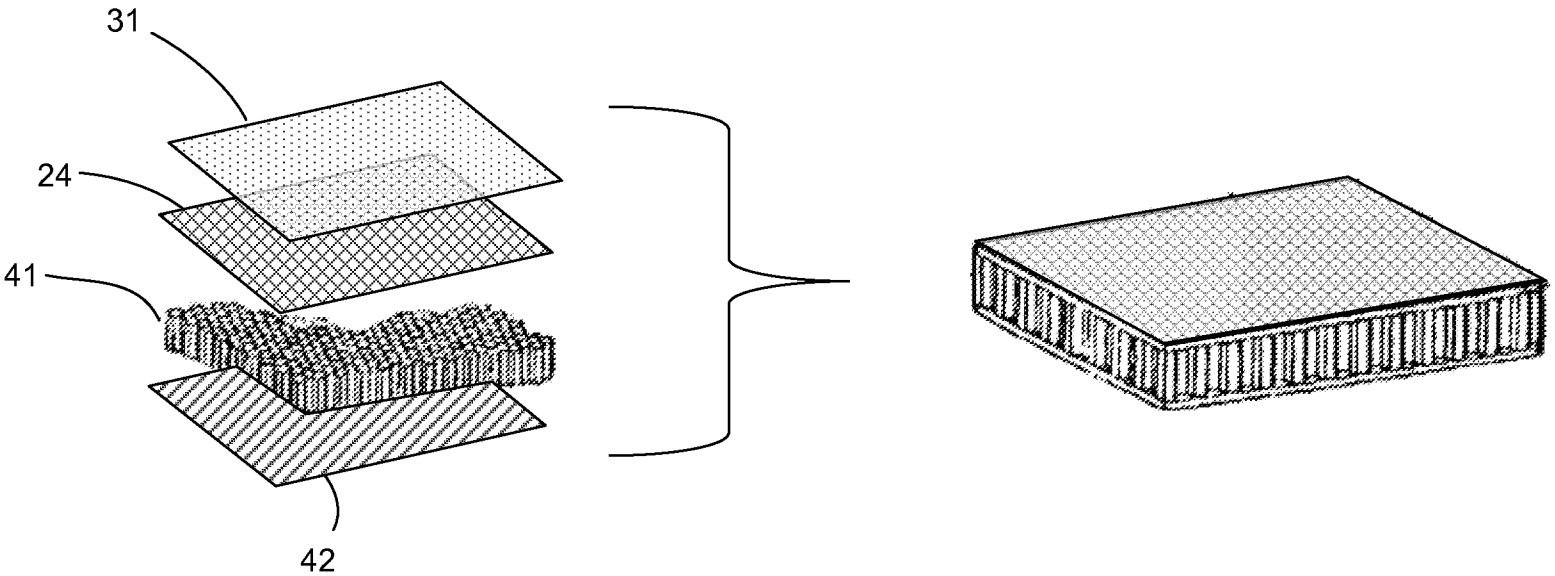
FIG. 5 illustrates a laminated structure according to a further implementation.

Referring now to FIG. 5, in some implementations, a laminated arrangement including the first layer 31 and the second layer 24 may be bonded to a reinforcing core material 41. A reinforcing core material 41 may be or include a conventional honeycomb material, such as graphite aramid or PBO fiber reinforced plastic, aramid paper, or aluminum alloy, for example. In some implementations, a rigid "skin" 42 may be adhered to a back surface of reinforcing core material 41 thereby forming a "sandwich" structure, wherein the reinforcing core material 41 is disposed between the rigid skin 42 and the laminated arrangement of the first layer 31 and the second layer 24.

Figure 6:
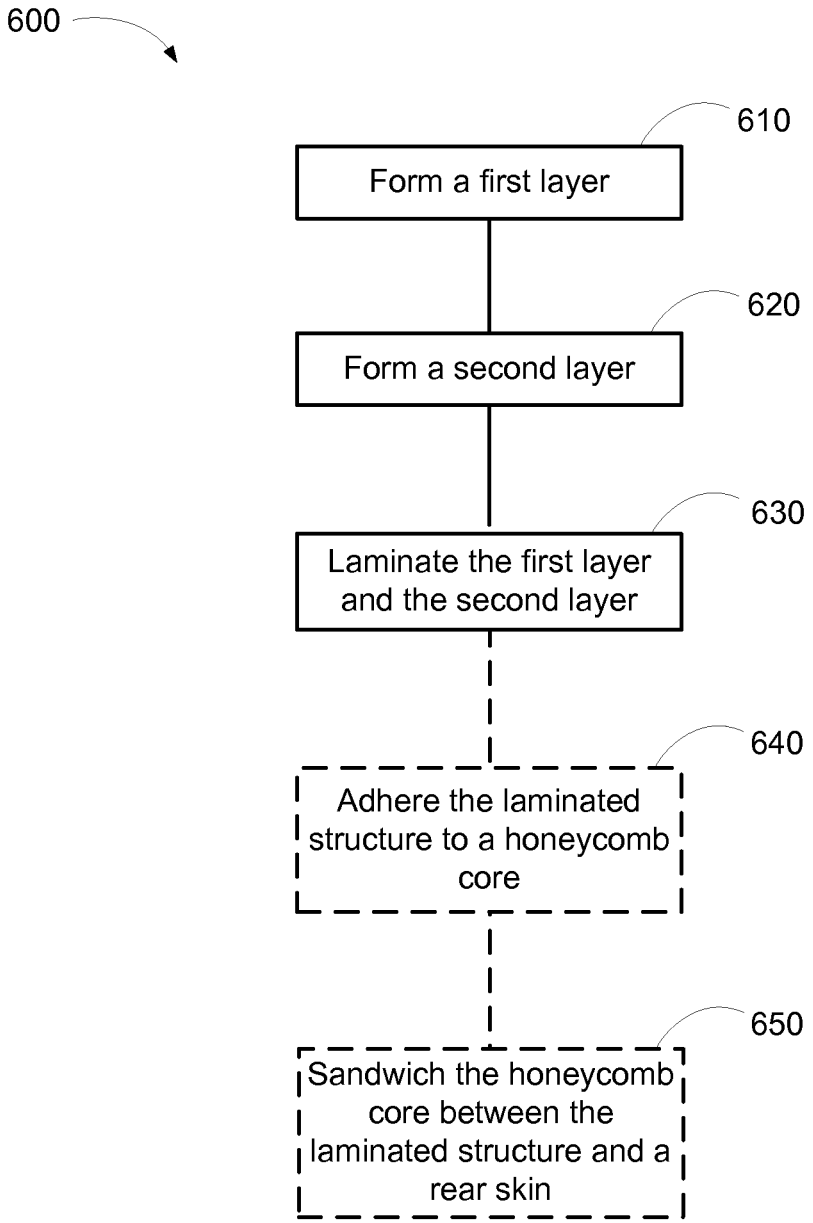
FIG. 6 illustrates a method for fabricating a laminated structure, according to an implementation.

Referring now to FIG. 6, a method for fabricating a laminated structure for an antenna reflector member will be described. The method 600 may include a step 610 of forming a first layer of an electrically conductive and electrically reflective material. In some implementations, the first layer may include a number of gores. Each gore may include or be composed of a nonwoven metallized fiber matte. Advantageously, the nonwoven metallized fiber matte may be acoustically permeable. In some implementations, forming the first layer includes laying the gores on a reflector mold.

At step 620, a second layer may be formed. The second layer may also include a number of gores, where each gore include or is composed of an open weave fabric. Advantageously, the fabric may be acoustically permeable. In some implementations, forming the second layer includes laying the gores of open weave fabric on the first layer.

At step 630, the first layer may be laminated with the second layer to form a laminated structure. In some implementations, laminating the first layer with the second layer includes co-curing. Co-curing may include combining the first and second layers before they are placed on a mold and cured, or placing the first layer and then second layer sequentially onto a mold prior to the application of heat and pressure for curing, for example.

In some implementations, referring still to FIG. 6, the laminated structure may be adhered to a honeycomb core, step 640. In addition, in some implementations, the honeycomb core may be sandwiched between the laminated structure and a rear skin, step 650.

Thus, an improved reflective and permeable metallized laminate has been disclosed. The foregoing merely illustrates principles of the invention. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. An antenna reflector comprising a laminated structure including a first layer and a second layer, wherein:

the first layer is a nonwoven metallized fiber matte including metallized, randomly oriented, short-chopped fibers disposed within a binder, the nonwoven metallized fiber matte having a substantial percentage of open volume provided by randomly dispersed openings, an electrically conductive and electrically reflective front surface, and a rear surface laminated to a front surface of the second layer; and the second layer includes an open weave fabric.

2. The antenna reflector of claim 1, wherein the laminated structure is acoustically permeable.

3. The antenna reflector of claim 1, wherein the first layer and the second layer are co-cured.

4. The antenna reflector of claim 1, wherein the first layer and the second layer are bonded after curing the open weave fabric.

5. The antenna reflector of claim 1, wherein each of the first layer and a second layer has a thickness not greater than 0.05 inches.

6. The antenna reflector of claim 1, further comprising a honeycomb core.

7. The antenna reflector of claim 6, wherein the honeycomb core is sandwiched between the laminated structure and a rear skin, the laminated structure being disposed proximate to a first surface of the honeycomb core and the rear skin being disposed proximate to a second surface of the honeycomb core, the second surface being opposite to the first surface.

8. The antenna reflector of claim 1, wherein the fiber matte includes one or more of carbon fibers, carbon composite fibers, polyamide fibers and glass fibers.

9. The antenna reflector of claim 1, wherein the open weave fabric is triaxially woven.

10. The antenna reflector of claim 1, wherein the open weave fabric includes one or more of carbon fibers, carbon composite fibers, polyamide fibers and glass fibers.

11. A method of fabricating a laminated structure for an antenna reflector member, the method comprising:

forming a first layer of an electrically conductive and electrically reflective material, the first layer including a first plurality of gores, each gore including a nonwoven metallized fiber matte including metallized, randomly oriented short-chopped fibers disposed within a binder, the nonwoven metallized fiber matte having a substantial percentage of open volume provided by randomly dispersed openings, an electrically conductive and electrically reflective front surface, and a rear surface;

forming a second layer, the second layer including a second plurality of gores, each gore including an open weave fabric; and laminating the rear surface of the first layer to a front surface of the second layer to form the laminated structure.

12. The method of claim 11, wherein the laminated structure is acoustically permeable.

13. The method of claim 11, wherein forming the first layer includes laying the first plurality of gores on a reflector mold.

14. The method of claim 11, wherein forming the second layer includes laying the second plurality of gores on the first layer.

15. The method of claim 11, wherein laminating includes co-curing.

16. The method of claim 11, wherein laminating includes bonding.

17. The method of claim 16, wherein the first layer and the second layer are bonded after curing the open weave fabric.

18. The method of claim 11, wherein each of the first layer and a second layer has a thickness not greater than 0.05 inches.

19. The method of claim 11, further comprising adhering the laminated structure to a honeycomb core.

20. The method of claim 19, further comprising sandwiching the honeycomb core between the laminated structure and a rear skin, wherein the laminated structure is disposed proximate to a first surface of the honeycomb core, and the rear skin is disposed proximate to a second surface of the honeycomb core opposite to the first surface.

* * * * *